US007201402B2

(12) United States Patent
Duprey

(10) Patent No.: US 7,201,402 B2
(45) Date of Patent: Apr. 10, 2007

(54) BOOK WITH SPINNING GLOBE

(76) Inventor: John F. Duprey, 807 Sixth St., Watervliet, NY (US) 12189

( * ) Notice: Subject to any disclaimer, the term of this patent is extended or adjusted under 35 U.S.C. 154(b) by 155 days.

(21) Appl. No.: 10/960,069

(22) Filed: Oct. 8, 2004

(65) Prior Publication Data

US 2006/0076770 A1 Apr. 13, 2006

(51) Int. Cl.
*B42D 1/00* (2006.01)
*B42D 5/00* (2006.01)

(52) U.S. Cl. ..... 281/38; 281/15.1; 281/21.1; 281/29; 281/36; 281/37; 281/43; 281/45; 19/28; 19/29; 446/147; 446/151; 446/152; 434/365; 434/404

(58) Field of Classification Search ..... 281/15.1, 281/21.1, 29, 36–38, 43, 45; 446/147, 151, 446/152; 434/404, 365; D19/28, 29
See application file for complete search history.

(56) References Cited

U.S. PATENT DOCUMENTS

| | | | | | |
|---|---|---|---|---|---|
| 3,289,333 | A | | 12/1966 | Watrous, Jr. | |
| 4,120,100 | A | | 10/1978 | Dugan | |
| 4,133,590 | A | * | 1/1979 | Young | 312/183 |
| 4,537,576 | A | * | 8/1985 | Thorsheim et al. | 434/404 |
| 4,642,054 | A | * | 2/1987 | Wada | 434/178 |
| D313,044 | S | | 12/1990 | Spak | |
| 5,104,167 | A | * | 4/1992 | Nemeth | 294/137 |
| D337,349 | S | | 7/1993 | Woodburn | |
| 5,653,470 | A | | 8/1997 | Bennett | |
| D389,181 | S | | 1/1998 | Fernandes et al. | |
| 5,758,780 | A | * | 6/1998 | Baumgarten | 211/46 |
| 5,915,729 | A | * | 6/1999 | Vap | 281/22 |
| 5,941,570 | A | * | 8/1999 | Cole et al. | 281/38 |
| 5,954,518 | A | | 9/1999 | Teichberg | |
| 5,962,087 | A | * | 10/1999 | Ruschak et al. | 428/16 |
| 5,988,684 | A | | 11/1999 | Blaustein et al. | |
| D450,763 | S | | 11/2001 | Fernandes et al. | |
| D452,524 | S | * | 12/2001 | Fernandes et al. | D19/26 |
| D452,876 | S | | 1/2002 | Fernandes et al. | |
| 6,402,523 | B1 | | 6/2002 | Kaufman et al. | |
| D469,801 | S | * | 2/2003 | Scott et al. | D19/26 |
| D515,625 | S | * | 2/2006 | Loo | D19/26 |
| 2002/0081560 | A1 | | 6/2002 | Ka-wah et al. | |
| 2004/0009460 | A1 | | 1/2004 | Polick | |
| 2004/0128876 | A1 | | 7/2004 | Cheek et al. | |
| 2005/0227208 | A1 | * | 10/2005 | Beascoa et al. | 434/131 |

* cited by examiner

*Primary Examiner*—Monica Carter
*Assistant Examiner*—Mark Henderson
(74) *Attorney, Agent, or Firm*—Richard C. Litman

(57) ABSTRACT

The book with spinning globe has a front cover, a back cover, and a spine or binding portion which binds the front cover, and the back cover. An earth globe is rotatably connected to a front cover, back cover, or spine so that the globe is rotatable about an axis extending along a plane of the front cover, back cover, or spine to which the globe is connected. The book may optionally include at least one leaf positioned between the front and the back cover. The globe may also be rotatably connected to the leaf. The globe is configured to represent the earth, and has outlines representing the continents and at least larger countries or geographical regions, and may have contours representing mountains or other features.

13 Claims, 11 Drawing Sheets

BOOK WITH SPINNING GLOBE

BACKGROUND OF THE INVENTION

1. Field of the Invention

The present invention relates to an educational book, and more particularly, to an educational book having a revolving globe disposed therein.

2. Description of the Related Art

Knowledge of geography is essential for appreciating the physical and social aspects of the complex global world in which we live. Often times, however, conventional books relating to geography fail to maintain the interest of a young reader. This may be due to the fact that the topics discussed are sometimes difficult for a child to understand. For example, many books make reference to different regions or geographical areas in the world with which a young reader is not familiar. When a globe or atlas is not available, it becomes difficult for a young reader to properly distinguish between the different geographical locations discussed. It is also difficult for some children to understand day/night cycles. In addition, some young children may need something more than the text and pictures in most conventional books in order to remain engaged in the topic being discussed. Thus, an educational book which includes a revolving globe disposed therein would be desirable.

Thus, a book with a spinning globe solving the aforementioned problems is desired.

SUMMARY OF THE INVENTION

The book with a spinning globe according to the present invention includes a front cover, a back cover, and a spine or binding portion which binds the front cover and the back cover. An earth globe is rotatably connected to the front cover, back cover, or spine so that the globe is rotatable about an axis extending along a plane of the front cover, back cover, or spine to which the globe is connected. The book may optionally include at least one leaf positioned between the front and the back cover. The globe may also be rotatably connected to a leaf. The globe is configured to represent the earth, and has outlines representing the continents and at least larger countries or geographical regions, and may have contours representing mountains or other features.

The book conveniently provides a young reader with access to a globe so that the reader will acquire a better understanding of world geography, the earth's rotation about an axis, and day/night cycles. For some, such as children who rely on others to read, the globe also provides a source of amusement and helps to maintain a child's focus on the book rather than other surrounding objects. . . .

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
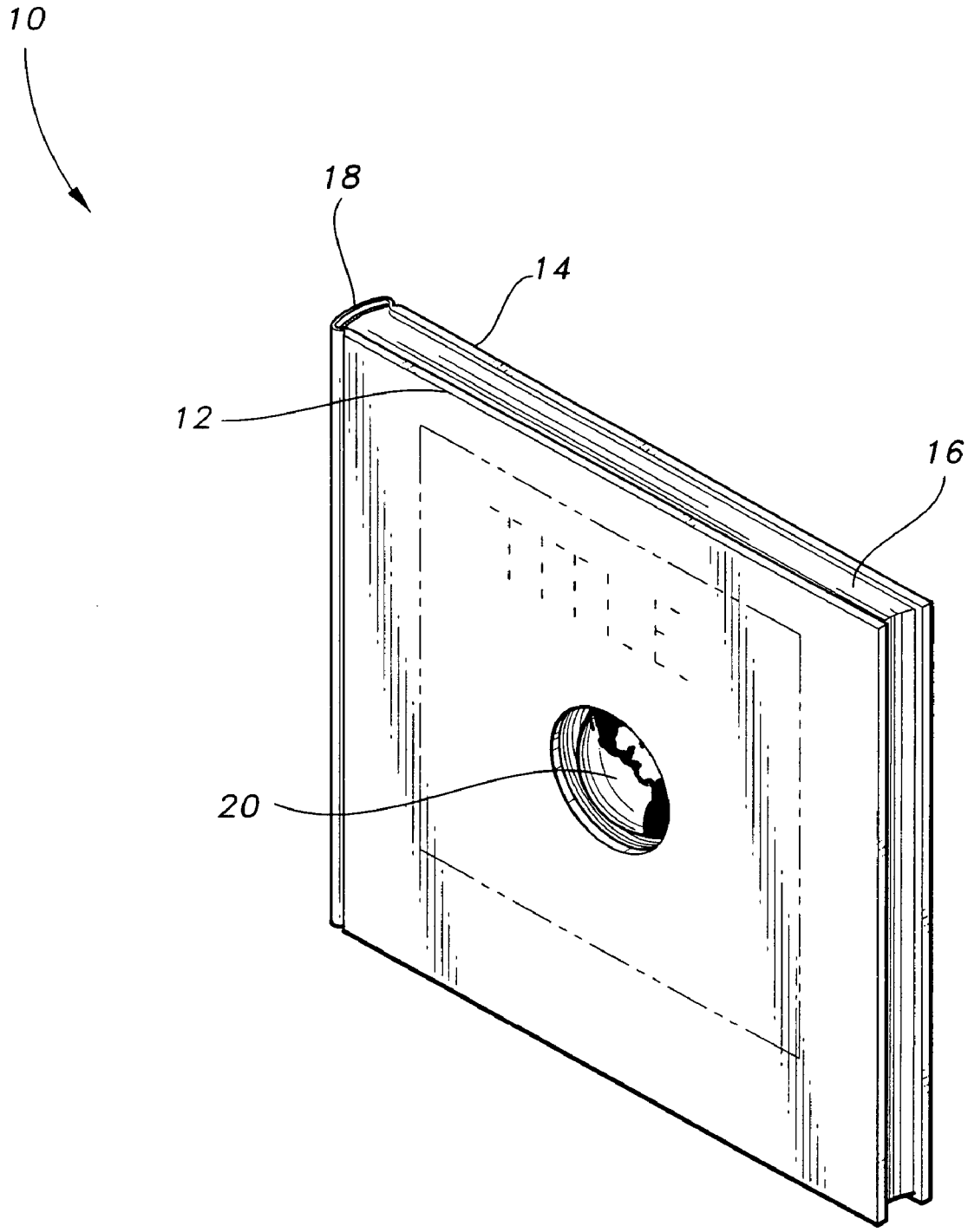
FIG. 1 is a perspective view of a book with spinning globe according to a first embodiment of the present invention.
Figure 2:
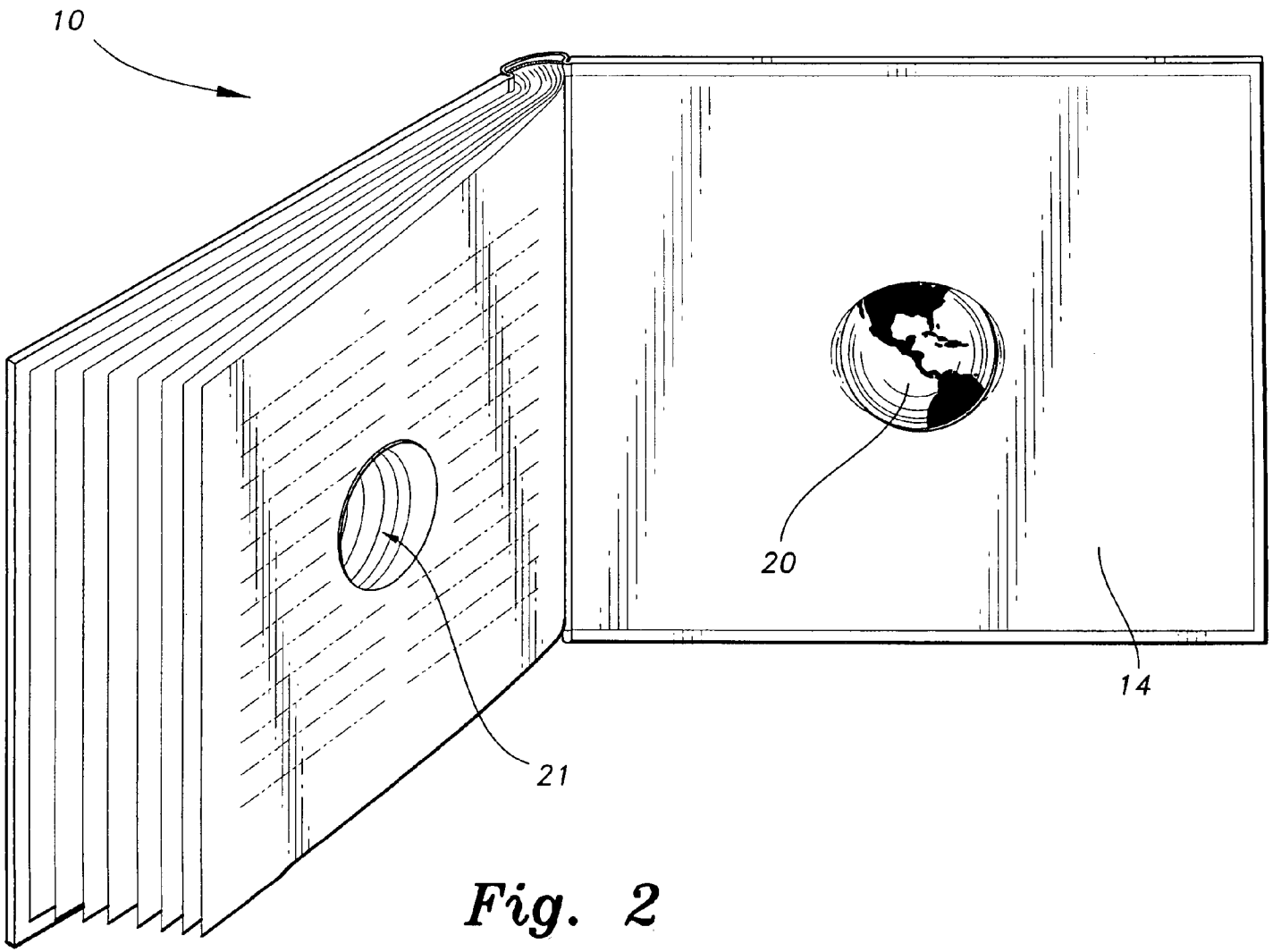
FIG. 2 is a perspective view of the book of FIG. 1, showing the back cover of the book.
Figure 3:
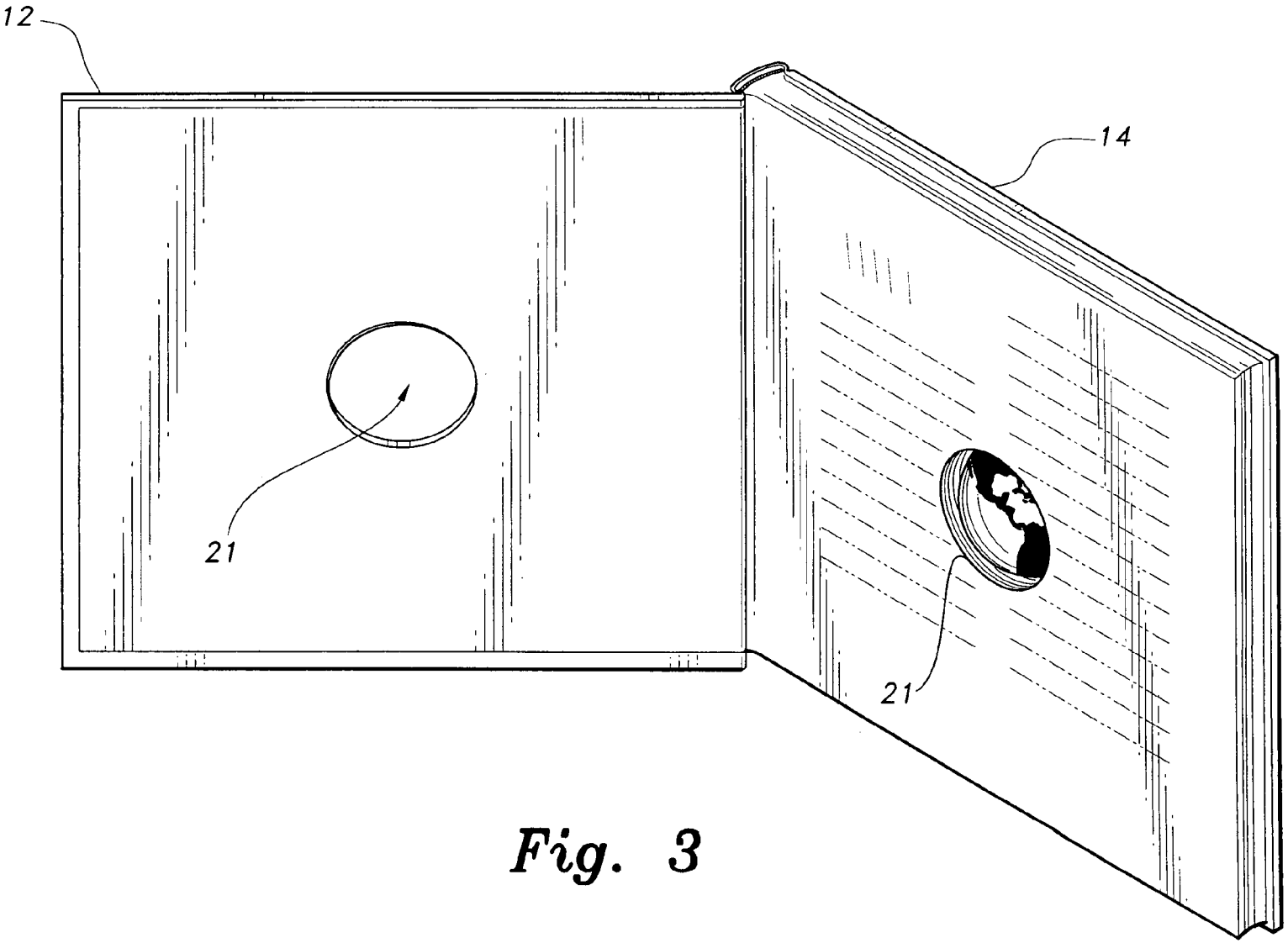
FIG. 3 is a perspective view of the book of FIG. 1, showing the cutout portions in the front cover and in the leaves.

The present invention relates to a book with a spinning globe, generally designated as 10 in the drawings. As can be seen in FIG. 1, the book 10 includes a book skeleton or book cover assembly, including a front cover 12, a back cover 14, and a spine or binding portion 18 which binds the front cover 12 to the back cover 14. The book 10 includes a three-dimensional globe 20, which may be rotatably attached to the book skeleton. As is shown, the book 10 may optionally include at least one leaf 16 positioned between the front cover 12 and the back cover 14, and bound to the spine 18 in any suitable manner known in the art. In one embodiment, the globe 20 is attached to the back cover 14, as can be seen more clearly in FIG. 2. The globe 20 includes a map or image of the earth on its exterior surface, including any or all of the indicia of a standard reproduction of the earth's surface. Thus, the map may include raised portions or contours to represent mountain ranges, as well as other topography. The globe 20 can be made from plastic, fabric, foam, or any other suitable material. The book can be made from any suitable material such as paper, plastic, or leather. As is shown in FIG. 3, the front cover 12 and each leaf 16 include a cutout portion 21 through which the globe 20 may protrude.

Figure 5:
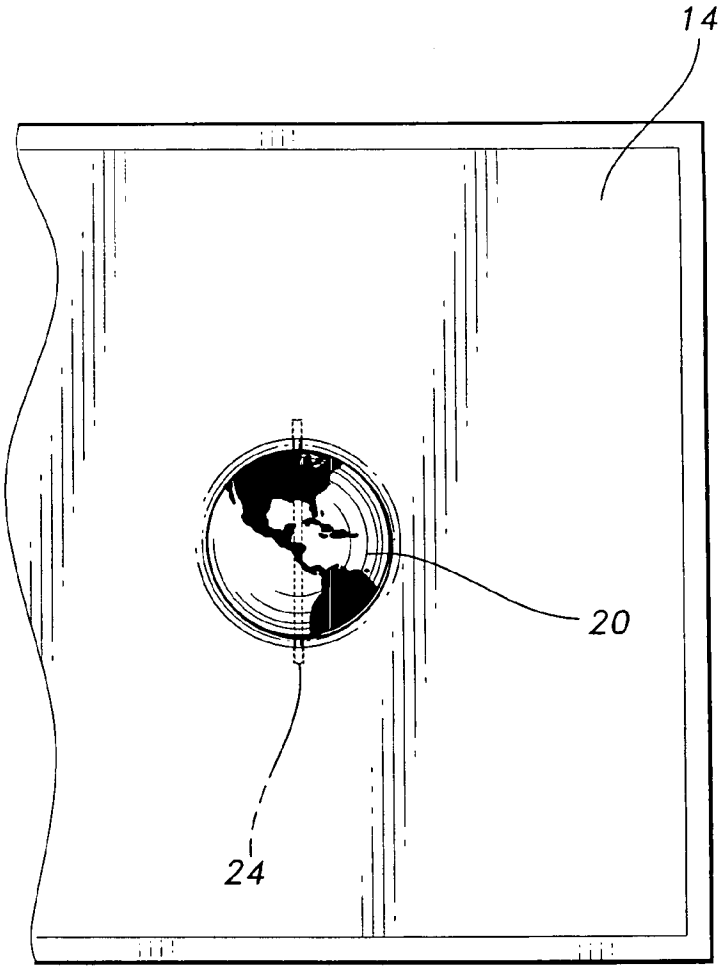
FIG. 5 is a fragmented perspective view of the back cover of the book of FIG. 1.
Figure 4:
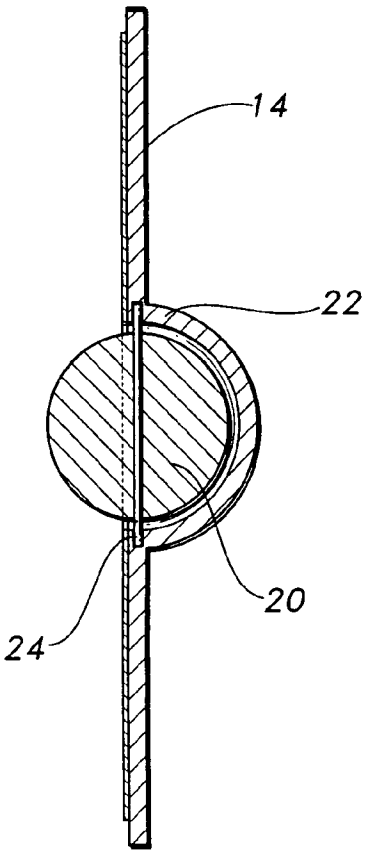
FIG. 4 is a fragmented sectional view of the back cover of a book of FIG. 1

The globe 20 may be rotatably mounted in any suitable manner. FIG. 4 depicts an exemplary sectional view of a portion of the back cover 14 and the globe 20 positioned within the back cover 14. As can be seen, a supportive frame 22 may be disposed within the back cover 14 for receiving the globe 20. The frame 22 can be hemispherical, semicircular, arcuate, or of any other suitable shape or structure. The frame 22 can be made from any suitable material, including, but not limited to, metal or plastic. The globe 20 can be positioned within the frame 22 in any conventional manner that would allow a user to manually rotate the globe 20 within the frame 22. For example, a rod 24 or other suitable cylindrical structure may extend through the globe 20 and attach at its opposing ends to the frame 22, as shown in FIGS. 4 and 5. The globe 20 may thereby revolve around the rod 24 when manually spun. The globe 20 may be equipped with bearings where the rod 24 enters and exits the globe 20 to ensure smooth rotation of the globe 20 around the rod 24.

Figure 6:
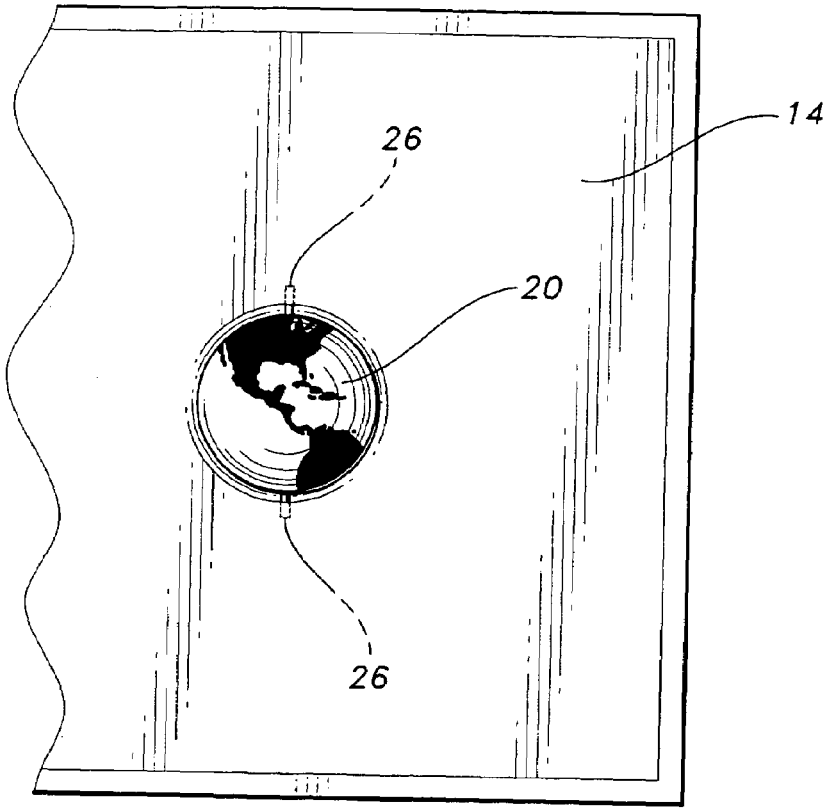
FIG. 6 is a fragmented perspective view of the book of FIG. 1, showing an alternate method of mounting the globe to the cover.

In another embodiment, shown in FIG. 6, pins 26 may be provided to connect the globe 20 to the frame 22. The pins 26 may be fixed to diametrically opposed positions of the globe 20 and configured to rotate in holes defined within the frame 22. Alternatively, the pins 26 may be fixed in the frame 22, but rotatably mounted to the globe 20.

Figure 7:
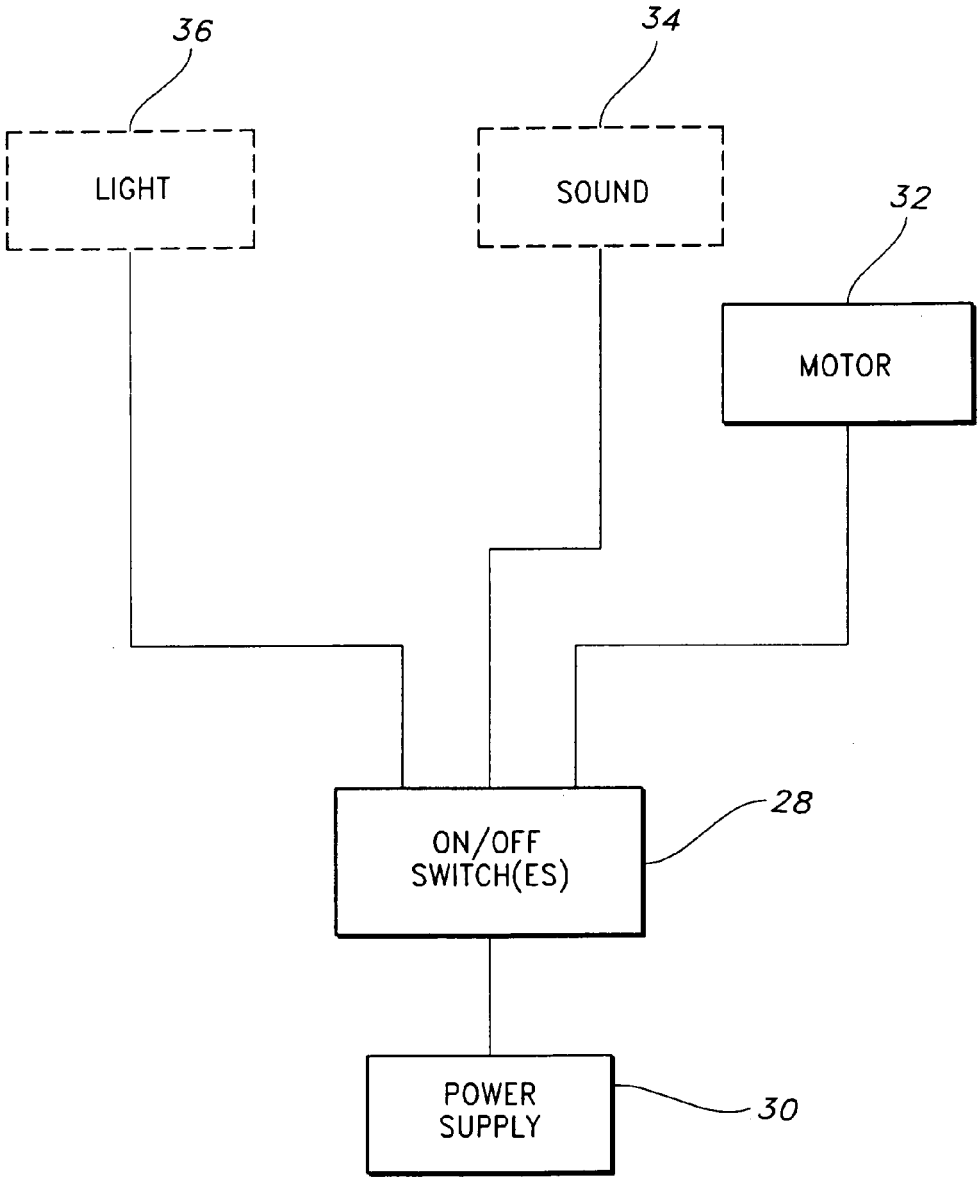
FIG. 7 is a block diagram of optional electronic circuitry for a book with spinning globe according to the present invention for illuminating the globe, playing an audio message, or rotating the globe.

Optionally, the book 10 may be configured to allow for automated rotation of the globe 20, illumination of the globe 20, and/or activation of an audio device. Automation of the book 10 can be accomplished in any conventional manner known in the art. As shown in FIG. 7, the book may be equipped with one or more switches 28, which may be located on the body of the book 10, on the globe 20, or on the frame 22, that can be triggered to connect a power supply 30 to an appropriate electrical device or circuit. The power supply 30 can be, for example, one or more batteries, e.g., a watch battery, AA or AAA alkaline batteries, a lithium battery, etc. The power supply 30 provides sufficient voltage and current to activate a motor 32, a sound device 34 and/or a light source 36. Alternatively, however, the book 10 may be configured in any suitable manner known in the art which would allow the motor 32, the sound device 34, and/or the light source 36 to be activated when a user touches designated portions of the globe 20 or the book 10, e.g., by capacitance switches, etc., as is well known in the electrical arts Activation of the motor 32 initiates rotation of the globe 20. Rotation of the globe 20 provides a child with a better understanding of how the earth revolves on its axis and the cycles of day and night. The motor 32 may be a small piezoelectric motor, a stepper motor, or any other motor known in the art.

Activation of the light source 36 illuminates the globe 20. Illumination of the globe 20 allows a child to use the globe 20 at night, while traveling in a car, for example. The light source 36 may be an incandescent light, one or more light emitting diodes, a fluorescent light, or any other illumination source known in the electrical arts. For this purpose, the globe 20 may be made of translucent material and the light source may be disposed within, behind, above, or below the globe 20.

Activation of the sound device 34 triggers an audio message which identifies or describes the geographic location(s) which are displayed once the globe 20 has returned to a stationary position after spinning. The sound device 34 may be a magnetic tape or audio chip connected to a speaker. For example, if the globe 20 stops its rotation with the continent of Europe displayed, the audio may recite an appropriate informational message, such as: "This is Europe, an area with many countries. These countries are Spain, France, Germany . . . "

Hence, the book 10 provides an amusing diversion for children, as well as education regarding geography and the structure of the earth.

Figure 8:
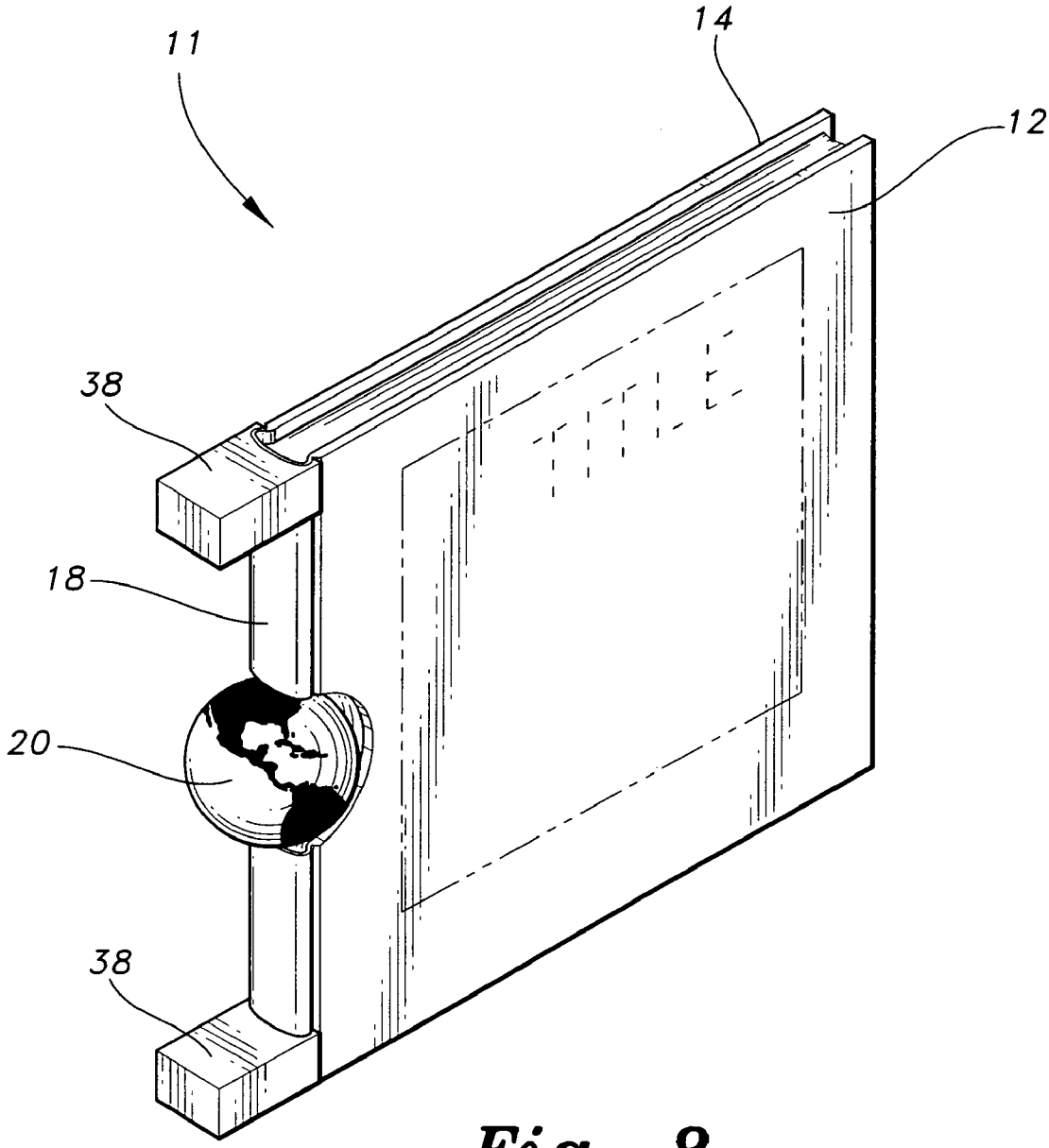
FIG. 8 is a perspective view of a book with spinning globe according to a second embodiment of the present invention.

FIG. 8 depicts yet another embodiment of the book, generally designated as 11. The book 11 differs from the book 10 in that the globe 20 is rotatably attached to the spine 18, rather than to the back cover 14, and a pair of support structures 38 extend from the spine 18. Also, the book 11 does not include cutout portions 21. In all other respects, however, the book 11 is identical to the book 10. When the book 11 is opened on a horizontal support surface, the support structures 38 keep the spine 18 and the globe 20 raised above the horizontal support surface in order to facilitate rotation of the globe 20. The support structures 38 may be rectangular, as depicted, or any other shape that would maintain the spine 18 above a horizontal surface. The support structures 38 and the spine 18 can be made from one piece. Alternatively, however, the support structures 38 can be permanently or detachably connected to the spine 18 in any conventional manner. The support structures 38 can be made from plastic, wood, or other suitable material.

Figure 9:
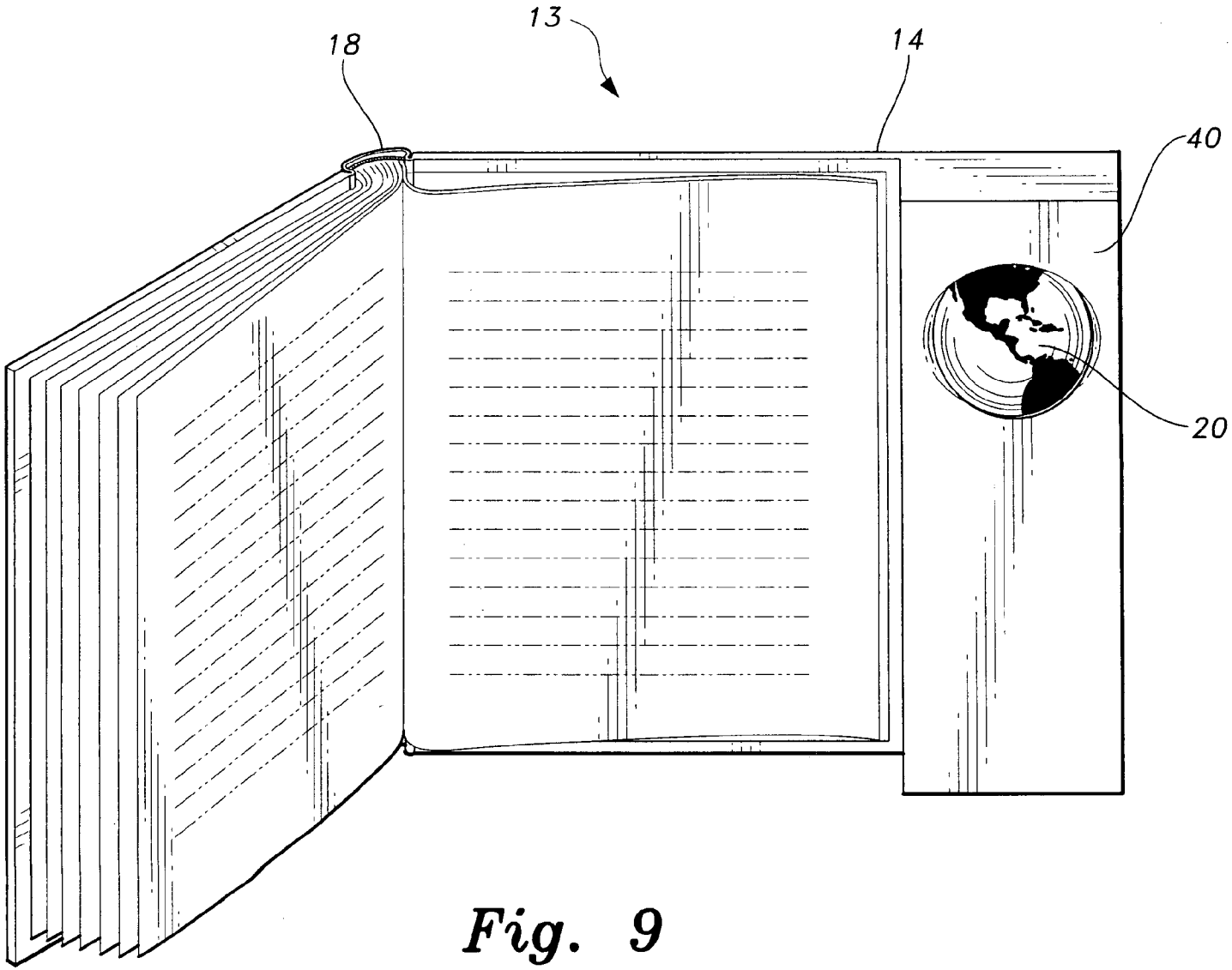
FIG. 9 is a perspective view of a book with spinning globe according to a third embodiment of the present invention.

FIG. 9 depicts yet another embodiment of the book, generally designated as 13. Unlike the book 11, the book 13 includes a side panel 40 extending from the back cover 14 and the globe 20 is rotatably connected to the side panel 40 instead of the spine 18. Also, the book 13 does not have support structures 38 in the spine 18. In all other respects, however, the book 13 is identical to the book 11.

Figure 10:
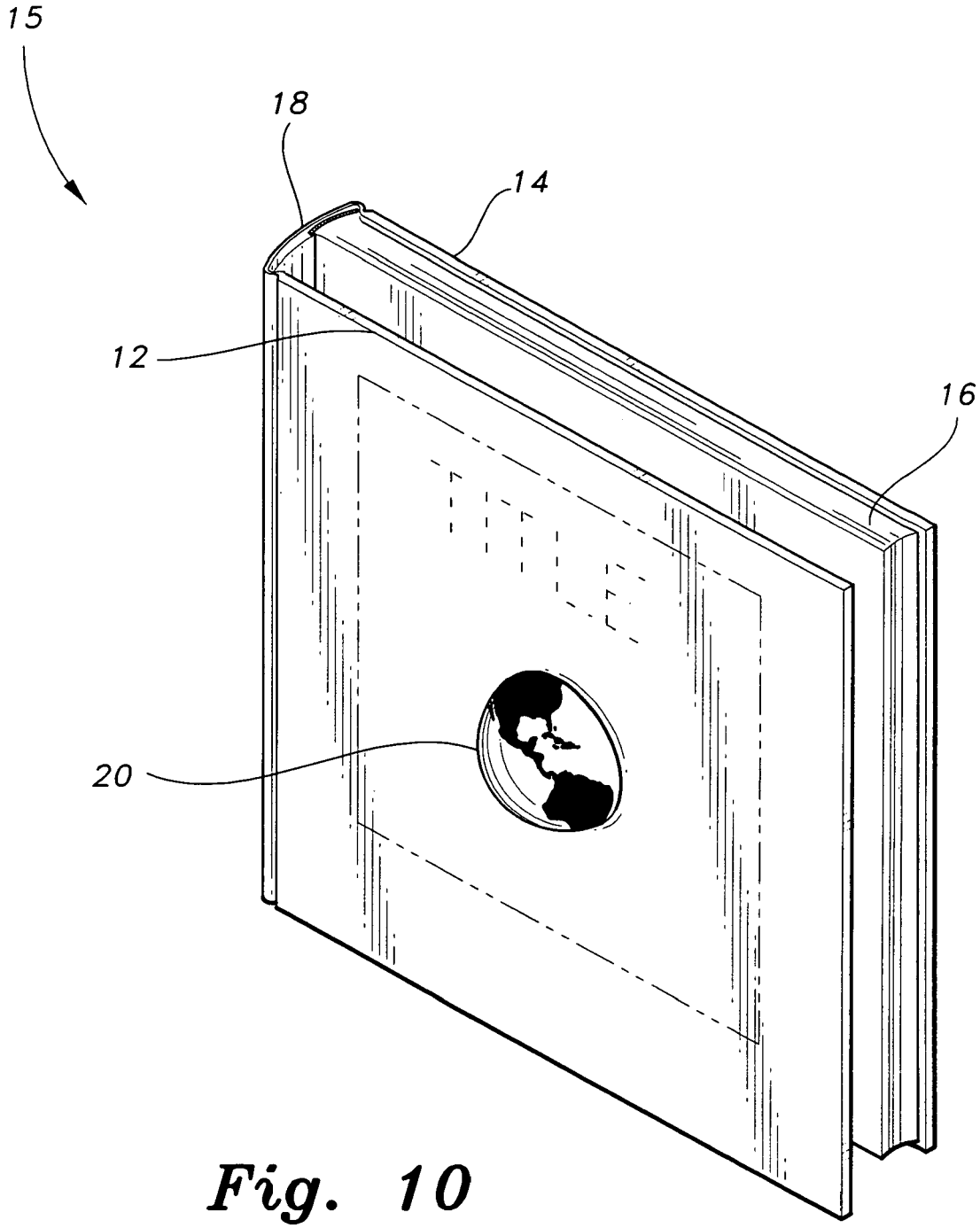
FIG. 10 is a perspective view of a book with spinning globe according to a fourth embodiment of the present invention.
Figure 11:
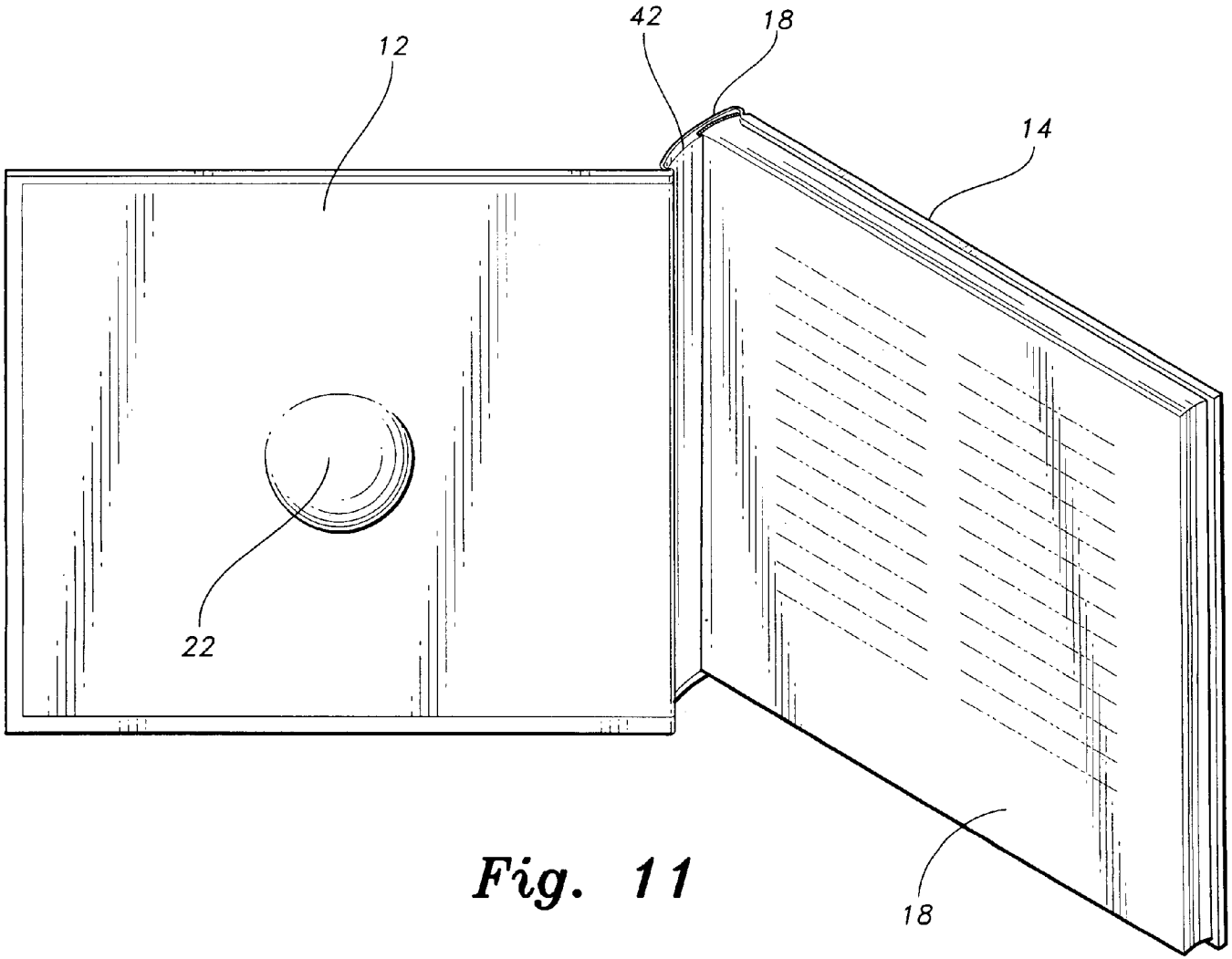
FIG. 11 is a perspective view of the book of FIG. 10, showing the book opened.

FIG. 10 depicts yet another embodiment of the book, generally designated as 15. The book 15 is identical to the book 13, except that the book 15 does not include a side panel 40 and the globe 20 is rotatably attached to the front cover 12. As shown more clearly in FIG. 11, the spine 18 of the book 15 can be configured to extend past the leaves 16 of the book 15 to form a gap 42 between the leaves 18 and the front cover 12. A portion of the globe 20 and/or the frame 22 that houses the globe 20 may thereby extend into the gap 42 when the book 10 is closed.

Figure 12:
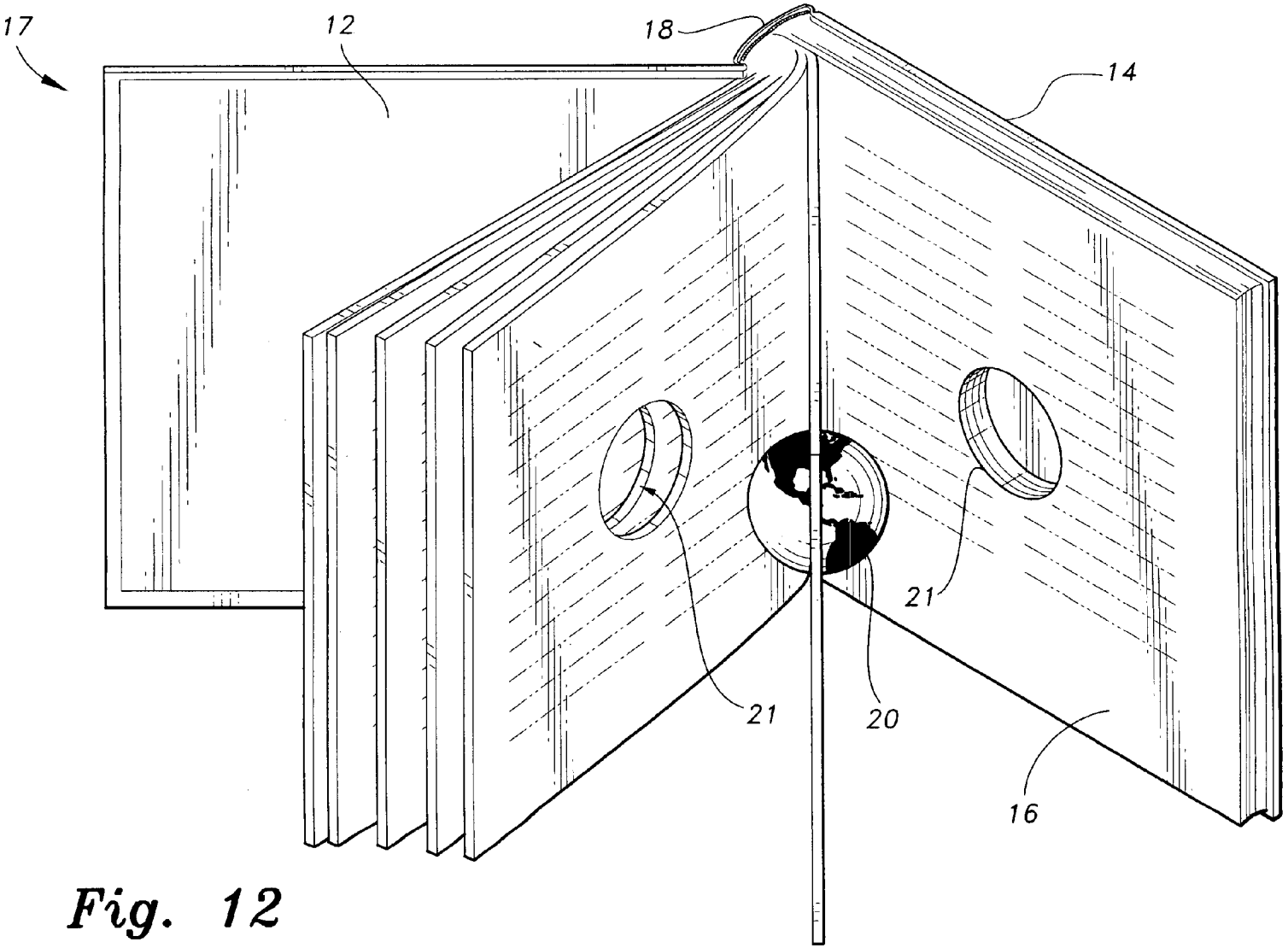
FIG. 12 is a perspective view of a book with spinning globe according to a fifth embodiment of the present invention.

FIG. 12, depicts yet another embodiment of the book, generally designated as 17. The book 17 is identical to the book 15, except that the spine 18 is not configured to extend past the leaves 16 of the book 10 and the globe 20 is rotatably connected to a leaf 16. It is preferable that the leaves of the book 17 be made from cardboard. If the book 10 includes more than one leaf 16, the remaining leaves 16 may be configured to include cutouts 21, as is shown.

It will be understood that the term "book", as used in the present application, is not limited to the conventional hard-back book depicted in the drawings, but encompasses any support device having a front cover, a back cover, and a spine or binding portion having means for supporting at least one leaf between the front cover and the back cover. Thus, photo albums, greeting cards, and binders fall within the meaning of "book" as used herein. It should also be understood that the book of the present invention includes other objects beside a globe which can be made to rotate in the book. Thus, the book may include, for example, a rotating object having the shape of an animal, human, alien, or fantasy object or being instead of a globe.

It is to be understood that the present invention is not limited to the embodiments described above, but encompasses any and all embodiments within the scope of the following claims.

I claim:

1. A book with spinning globe, comprising:

a book skeleton having a front cover, a back cover, and a spine joining the front cover to the back cover, the front cover defining a first cutout portion, the back cover defining a second cutout portion aligned with the first cutout portion;

at least one leaf attached to the spine, the at least one leaf defining a third cutout portion aligned with the first and second cutout portions;

a globe-supporting frame disposed within the skeleton;

a three-dimensional globe depicting the earth rotatably mounted within the frame, a rod extending through said globe, said rod having opposing ends attached to said frame, said globe being rotatable around said rod; and at least a portion of the globe protrudes through at least one of the first, second and third cutout portions such that the globe is partially visible and rotatable when the book is in the closed position, whereby the book is adapted for teaching children about geography of the earth.

2. The book according to claim 1, wherein said globe is made from plastic.

3. The book according to claim 1, wherein said globe is made from fabric.

4. The book according to claim 1, wherein said globe is made from foam.

5. The book according to claim 1, wherein said frame is made from metal.

6. The book according to claim 1, wherein said frame is made from plastic.

7. The book according to claim 1, further including means for rotating said globe electrically.

8. The book according to claim 1, further including means for illuminating said globe.

9. The book according to claim 1, further including means for delivering an educational audio message conveying information regarding a geographical area depicted on said globe.

10. The book according to claim 1, wherein said frame is mounted within said back cover.

11. The book according to claim 1, wherein said frame is mounted within said front cover.

12. The book according to claim 1, wherein said frame is mounted within said leaf.

13. A book with spinning globe, comprising:

a book skeleton having a front cover, a back cover, and a spine joining the front cover to the back cover;

at least one leaf attached to the spine;

a globe-supporting frame disposed within the skeleton;

a three-dimensional globe depicting the earth rotatably mounted within the frame, at least a portion of the globe being visible outside the frame, whereby the book is adapted for teaching children about geography of the earth; and wherein said back cover further includes a side panel extending from a side edge, said frame being mounted within said side panel.

* * * * *